United States Patent [19]

St. Denis

[11] 4,349,990

[45] Sep. 21, 1982

[54] SUPPORT FOR GRINDING THREAD CUTTING TOOLS

[76] Inventor: Joseph F. St. Denis, 26545 Oakland, Roseville, Mich. 48066

[21] Appl. No.: 300,702

[22] Filed: Sep. 9, 1981

Related U.S. Application Data

[63] Continuation of Ser. No. 120,906, Feb. 12, 1980, abandoned.

[51] Int. Cl.[3] ..... B24B 3/34

[52] U.S. Cl. ..... 51/220

[58] Field of Search ..... 51/218 R, 218 A, 220, 51/221, 288, 281 R

[56] References Cited

U.S. PATENT DOCUMENTS

| | | | |
|---|---|---|---|
| 1,908,155 | 5/1933 | Jorgensen | 51/220 |
| 2,410,494 | 11/1946 | Gedeon | 51/220 |
| 2,432,058 | 12/1947 | Wilken | 51/220 |
| 2,448,309 | 8/1948 | Greico | 51/220 |
| 2,735,245 | 2/1956 | Grieco | 51/220 |
| 4,109,421 | 8/1978 | St. Denis | 51/288 |

*Primary Examiner*—Harold D. Whitehead

*Attorney, Agent, or Firm*—Harness, Dickey & Pierce

[57] ABSTRACT

A grinding method and tool support assembly which permits the cutting angle and relief area of a cutting tool to be ground, using only the outer peripheral surface of the grinding wheel in a conventional back and forth movement. The support assembly comprises an upright member resting on a surface, an elongated tool support having mounting means so constructed that, when secured to the vertical portion of the upright member, the tool support is displaced from the horizontal by the desired tool cutting edge angle, and a fastener for the tool support mounting means which permits it to be rotated on a horizontal axis. This permits the tool to be clamped in position so that the cutting dge and relief angle may be ground simultaneously. The grinding method includes the steps of inclining the tool from a supporting surface at the desired tool cutting angle, rotating it parallel to the supporting surface to obtain the relief angle, grinding one cutting edge and its relief angle, and if necessary reversing the tool and repeating the aforementioned steps to grind the other side of the cutting edge and its relief angle.

2 Claims, 8 Drawing Figures

SUPPORT FOR GRINDING THREAD CUTTING TOOLS

This is a continuation of application Ser. No. 120,906 filed Feb. 12, 1980 and now abandoned.

BACKGROUND OF THE INVENTION

1. Field of the Invention

The invention relates to the grinding or dressing of tools such as those used for cutting threads, in which the thread cutting angle is to be formed on the tool together with a compound relief angle. Other cutting tools which may be ground or dressed with the present invention are, for example, those for slotting machines which cut internal splines or keyways, and internal spline gauges.

2. Description of the Prior Art

My U.S. Pat. No. 4,109,421 issued Aug. 29, 1978 shows a method for forming the cutting edge and relief angle of the thread cutting tool. However it requires that the grinding wheel go through several movements including a lateral movement (arrow 43 in FIG. 1 of said patent) which may cause uneven wear on the wheel.

BRIEF SUMMARY OF THE INVENTION

It is an object of the present invention to achieve the same results as the method and construction in the aforesaid patent without the requirement of lateral grinding wheel movement, but instead using only the outer peripheral surface of the grinding wheel in a conventional back and forth movement which is much more desirable from the standpoint of wear on a grinding wheel.

Briefly, the tool support assembly of this invention comprises an upright member having one side adapted to rest on a supporting surface and a second side extending at right angles thereto, an elongated tool support having a tool receiving slot permitting a tool therein to extend from one end thereof, mounting means for said tool support so constructed that, when secured to said second side of the upright member, the tool receiving slot may be initially displaced from said first side of the upright member by a first desired tool cutting edge angle, and fastening means releasably securing said mounting means to said second side of the upright member, said fastening means supporting said tool support on an axis extending at right angles to said second side, whereby rotation of said tool support about the axis of said fastening means will position the tool so as to permit a grinding wheel simultaneously to grind both the cutting edge and relief angle of the tool using the peripheral surface of the grinding wheel with a back and forth movement.

The method of this invention comprises the steps of holding said tool so that its longitudinal axis is inclined from a supporting surface at a predetermined cutting edge angle, rotating said tool in one direction about an axis parallel to said supporting surface until the relief angle for said cutting edge is obtained, securing the tool in said position, and simultaneously grinding said cutting edge and its relief angle by a back and forth motion using the periphery of a grinding wheel.

DESCRIPTION OF THE PREFERRED EMBODIMENTS

Figure 1:
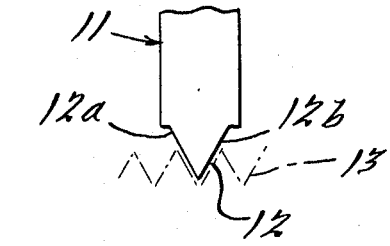
FIG. 1 is a top plan view of a portion of a thread cutting tool showing the cutting edge.
Figure 2:
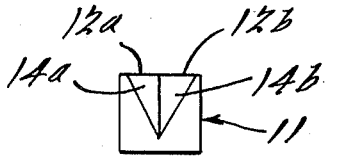
FIG. 2 is a front elevational view of the tool showing the relief angle.
Figure 3:
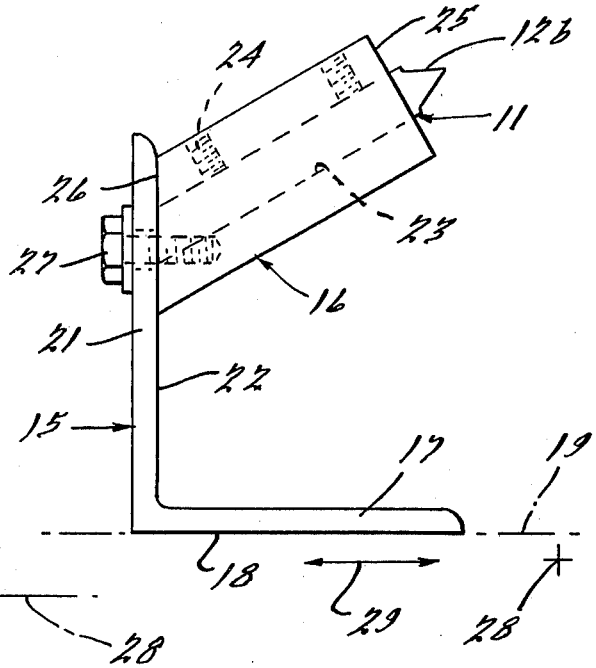
FIG. 3 is a side elevational view of one embodiment of the tool support assembly of this invention, particularly adapted for grinding thread cutting tools.

A thread cutting tool of the type which the present invention is intended to support is indicated generally at 11 in FIGS. 1 and 2. The elongated tool has a rectangular cross-sectional shape but is provided at its forward end with a cutting edge 12. This edge is complementary to the thread to be cut. For example, FIG. 3 shows in dot-dash lines a portion of a V thread indicated at 13, in which case cutting edge 12 would comprise two portions **12*a* and 12*b* which are 60° apart. The tool is relieved adjacent these two cutting edge portions on a compound relief angle, leaving a rake surface 14*a* adjacent cutting edge 12*a* and a rake surface 14*b* adjacent cutting edge 12*b***.

Figure 4:
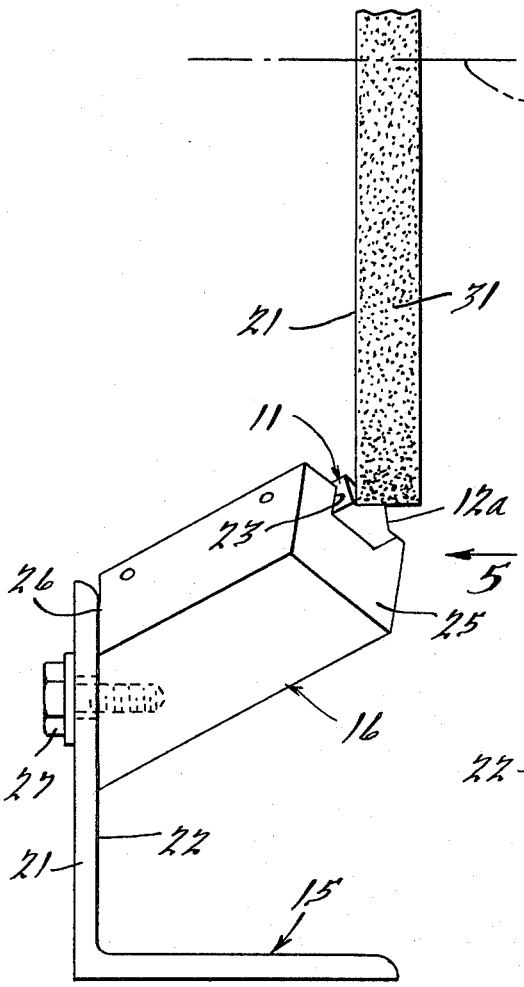
FIG. 4 is a view similar to FIG. 3 but showing the tool support after it has been rotated to a position permitting grinding of the relief angle.
Figure 5:
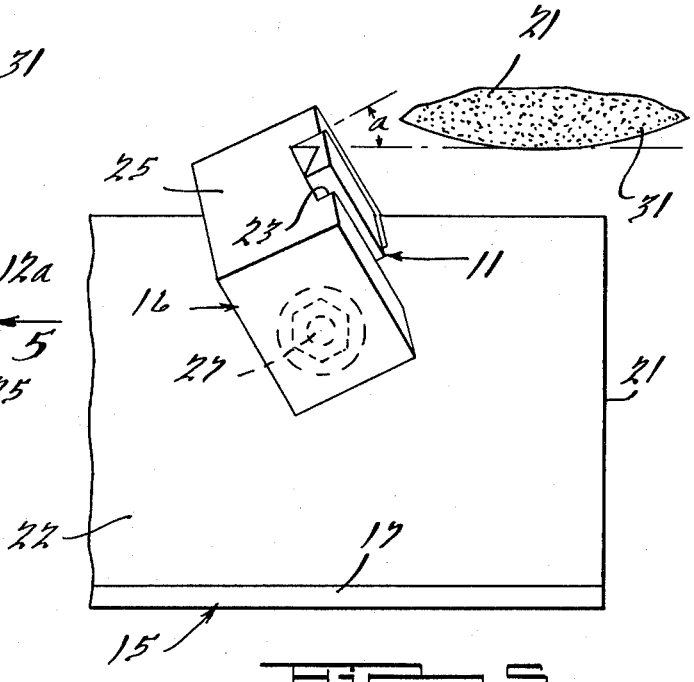
FIG. 5 is a front elevational view taken in the direction of the arrow 5 of FIG. 4.

Although the tool support assembly of this invention may take various forms depending upon requirements, it is shown in FIGS. 3 through 5 as comprising an upright member generally indicated at 15 and a tool support generally indicated at 16. Upright member 15 comprises a lower leg 17 having a surface 18 adapted to rest on the table 19 of a grinding machine having a grinding wheel 21. The upright member 15 may be secured to the table by any known method. Leg 21 of upright member 15 extends upwardly from leg 17 and has a surface 22 which is perpendicular to surface 18.

Tool support 16 is of elongated shape and has a slot 23 extending therealong for the reception of tool 11. One or more set screws or other fasteners 24 may be provided in the tool support for holding tool 11 in position within slot 23. The slot opens toward one end 25 of tool support 16 so that tool 11 may extend therefrom in readiness for grinding.

The other end 26 of tool support 16 is formed at an angle with respect the extent of slot 23. The angle is such that when end surface 26 is placed against surface 22 in one position, the axis of slot 23 will be displaced from surface 18 by one-half the angle of the thread to be cut. For example, assuming that thread 13 is a 60° thread to be cut by the tool, surface 26 is formed so that when it is secured to surface 22 in one position, the angle between slot 23 and surface 18 will be 30°.

A fastener 27 is used to secure tool support 16 to surface 22. This fastener may be in the form of a bolt which can be loosened to permit adjustment of tool support 16 and then tightened to clamp the tool support. The axis of bolt 27 is parallel to surface 18 so that when tool support 16 is rotatably adjusted, cutting surface 12*a* or 12*b*, depending upon which way the tool is mounted in the slot, will remain horizontal during the adjusting movement.

In operation of the tool support assembly of this invention, tool 11 will be mounted in slot 23 with one of the cutting edges, for example edge 12*b*, exposed at the forward end 25 of the tool support. The tool support will initially be placed in the position shown in FIG. 3 so that the 30° angle will be formed between slot 23 and surface 18. With fastener 27 slightly loosened, support 16 will be rotated about the axis of the fastener until it reaches the position of FIGS. 4 and 5 and will then be clamped in position. This will cause the relief angle a shown in FIG. 5 to be obtained while the cutting edge 12*b* will still remain horizontal. Grinding may then be accomplished simply by moving the axis 28 of grinding wheel 21 back and forth as shown by the double ended arrow 29 in FIG. 5. Only the peripheral surface 31 of the grinding wheel will be needed to grind or dress both the cutting edge 12*b* and the rake angle a of the tool.

After this has been accomplished, support 16 will be returned to its original position and tool 11 may be removed from slot 23 and reversed 180° on its axis so that cutting edge 12*a* rather than 12*b* is horizontal. The tool support will then be swung on the axis of fastener 27 in the opposite direction from that previously, in order to obtain the relief angle for cutting edge 12*a*. After the tool support is again clamped, the peripheral surface of the grinding wheel may then be utilized with a back and forth motion to grind both cutting edge 12*a* and its relief angle.

Figure 6:
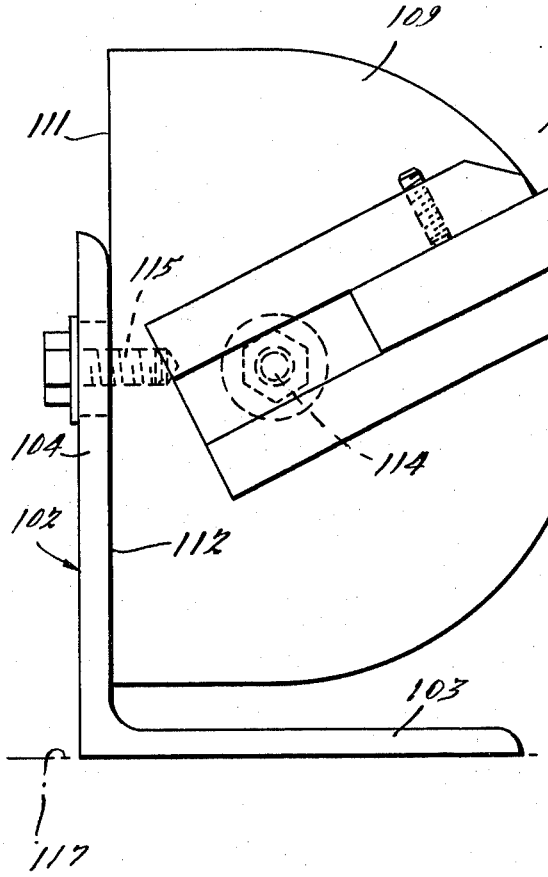
FIG. 6 is a side elevational view of another embodiment of the tool support assembly which is capable of grinding any tool cutting clearance and is usable for slotting machines, cutting internal splines and roughing out internal Acme gauges.
Figure 7:
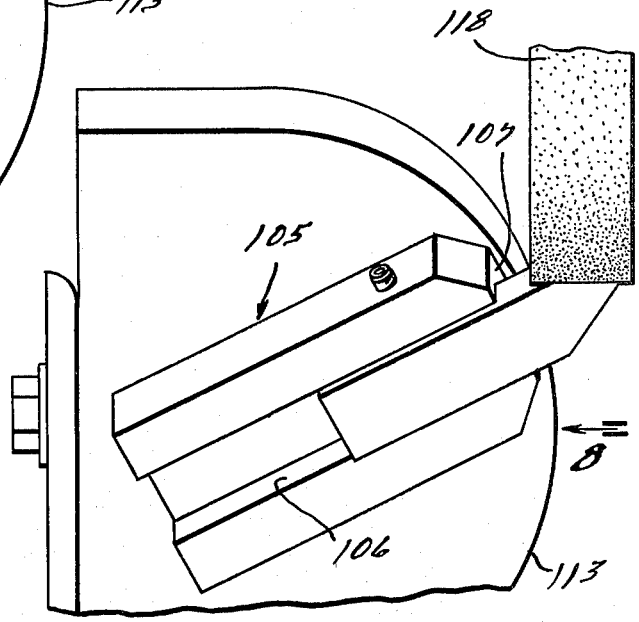
FIG. 7 is a view similar to FIG. 6 but showing the tool support after it has been rotated to a position permitting grinding of the relief angle.
Figure 8:
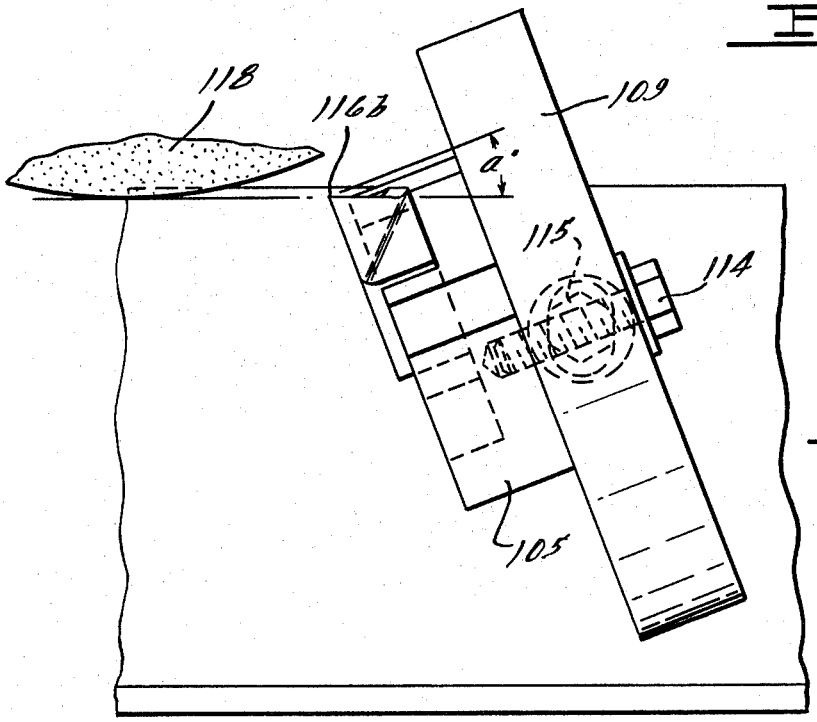
FIG. 8 is a front elevational view taken in the direction of the arrow 8 of FIG. 7.

FIGS. 6, 7 and 8 show another embodiment of the invention which is of more universal application than that of FIGS. 3, 4 and 5. The unit is generally indicated at 101 and comprises an upright member generally indicated at 102 having a first leg 103 and a second or upper leg 104. The elongated tool support is generally indicated at 105 and has a slot 106 opened at one end 107 in which a tool to be ground, indicated at 108, may be mounted. A mounting member 109 is provided for tool support 105. This mounting member has a mounting surface 111 which is placed against surface 112 of upright member 104, and an arcuate forward edge 113. Tool support 105 is attached to mounting member 109 by a pivotal connection 114. This connection is perpendicular to the axis of fastening means 115 which secures mounting member 109 to upright member 104. Thus, tool support 105 may be adjusted to any desired angular position about pivot 114, depending on the desired cutting edge angle of tool 108. To obtain the relief angle, mounting member 109 is rotated about the axis of pivotal fastener 115.

In operation of tool support assembly 101, tool 108 will be mounted in slot 106 with one of its cutting edges, for example edge 116*b*, exposed at support end 107. Tool support 105 will initially be rotated about axis 114 so as to form the proper angle between support surface 117 and desired cutting edge 116*b*. If desired index marks could be placed on arcuate edge 113 to facilitate this adjustment. Mounting member 109 will then be rotated about the axis of fastener 115 until it is moved from the position of FIG. 6 to the position of FIG. 7 and will then be clamped in position. This will cause the relief angle $a^1$ shown in FIG. 8 to be obtained while the cutting edge 116*b* still remains horizontal. The tool will then be ground by a back and forth motion of the grinding wheel 118 as previously described. It will be noted that the embodiment of FIGS. 6, 7 and 8 is usable for grinding thread cutting tools but is also applicable to other uses such as slotting machines, cutting internal splines and roughing out and internal Acme gauges.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

I claim:

1. A tool support assembly for mounting a thread cutting tool having two cutting edges angularly related with respect to each other at the angle of the thread to be cut thereby and for positioning said tool relative to the periphery of a rotatably driven grinding wheel so that the cutting edges of said tool can be ground individually by separate grinding operations to sharpen said edges precisely at said thread angle and so that a desired relief for each cutting edge also can be ground in each grinding operation by a single angular adjustment of said support assembly, said assembly comprising:

support means having a flat mounting surface adapted to be disposed with said mounting surface transversely of and at right angles with respect to the rotational axis of the grinding wheel;

tool holding means having a flat seating surface on one end inclined with respect to the longitudinal axis of the holder at the same angle as said thread angle on and in engagement with said mounting surface;

connecting means including pivot means disposed with its axis at right angles to said mounting surface for releasably fastening said tool holding means on said support means with said mounting and seating surfaces in pressed mutual engagement, said tool holding means being angularly adjustable about said pivot means and said connecting means being operative to hold said tool holding means securely in any selected angularly adjusted position; and tool clamping means for releasably holding the thread cutting tool securely on said tool holding means with one cutting edge of the tool parallel to the rotational axis of the wheel and exposed for grinding adjacent to the periphery of said grinding wheel and further with the longitudinal axis of the tool disposed with respect to said seating surface at the same angle as said thread angle, whereby when said cutting tool is clamped on said tool holding means in the manner described said mounting and seating surfaces automatically position the tool with said one cutting edge thereof at right angles to said surfaces and parallel to the rotational axis of said grinding wheel and properly positioned with respect to the peripheral grinding surface of said wheel so that said one edge can be sharpened by a back and forth movement of said wheel along said rotational axis, whereby repositioning of said tool on said tool holding means by turning it 180° about its axis automatically disposes the other cutting edge thereof similarly with respect to said grinding wheel for sharpening of said other edge, and whereby any desired relief angle can be ground behind each cutting edge of the tool during each grinding operation without removing said tool from or changing its position with respect to said tool holding means by a single adjustment of said tool holding means angularly about said pivot means.

2. The combination according to claims 1 wherein said connecting means including said pivot means comprises a screw that extends through said mounting and seating surfaces and is adapted to be tightened to clamp said tool holding means to said support means and in a selected angularly adjusted position with respect thereto.

* * * * *